US008074391B2

(12) United States Patent
Petrůj

(10) Patent No.: US 8,074,391 B2
(45) Date of Patent: Dec. 13, 2011

(54) RECOIL ABSORBING FIREARM

(76) Inventor: Svatopluk Petrůj, Brno (CZ)

( * ) Notice: Subject to any disclaimer, the term of this patent is extended or adjusted under 35 U.S.C. 154(b) by 229 days.

(21) Appl. No.: 12/445,497

(22) PCT Filed: Oct. 24, 2007

(86) PCT No.: PCT/CZ2007/000093
§ 371 (c)(1),
(2), (4) Date: Apr. 14, 2009

(87) PCT Pub. No.: WO2008/049378
PCT Pub. Date: May 2, 2008

(65) Prior Publication Data

US 2010/0088942 A1 Apr. 15, 2010

(30) Foreign Application Priority Data

Oct. 25, 2006 (CZ) ..... PV 2006-677

(51) Int. Cl.
*F41A 3/44* (2006.01)
*F41A 3/50* (2006.01)

(52) U.S. Cl. ..... 42/1.06; 89/187.01; 89/189; 89/190

(58) Field of Classification Search ..... 42/1.06; 89/187.01, 188, 189, 190
See application file for complete search history.

(56) References Cited

U.S. PATENT DOCUMENTS

| | | | | |
|---|---|---|---|---|
| 1,020,596 | A * | 3/1912 | Brauning | 89/145 |
| 2,536,997 | A * | 1/1951 | Lippert et al. | 89/190 |
| 3,220,135 | A * | 11/1965 | Irusta | 42/70.01 |
| 3,672,255 | A | 6/1972 | Findlay et al. | |
| 5,014,595 | A | 5/1991 | Ducolon, Jr. | |
| 7,568,422 | B1 * | 8/2009 | Barrett | 89/180 |
| 2006/0260461 | A1 | 11/2006 | Rozhkov et al. | |

FOREIGN PATENT DOCUMENTS

| | | | |
|---|---|---|---|
| DE | 29613891 | U1 | 11/1996 |
| GB | 2256263 | A | 12/1992 |
| WO | 98/48235 | A1 | 10/1998 |

OTHER PUBLICATIONS

International Search Report dated Feb. 29, 2008.

* cited by examiner

*Primary Examiner* — Stephen M Johnson
(74) *Attorney, Agent, or Firm* — Buchanan Ingersoll & Rooney PC

(57) ABSTRACT

A firearm formed by a housing, in which an assembly of a carriage and a barrel with a muzzle brake, and a breech block are slidingly supported, wherein the breech block is equipped with a return spring that is supported on a rear support surface of the housing, has a counter weight slidingly disposed in a longitudinal space located between the housing and the carriage and has a support surface which leans against a rear end of the return spring, the said counter weight being seated in its front position on a front stop surface of the carriage. The breach block is seated in its rear position on a rear stop surface of the carriage, a front end of the return spring also leans against a front support surface of the housing in the front position of the breech block, whereby a transfer element protrudes into the path of the breech block, the transfer element being simultaneously supported on the carriage and on the counter weight, and in an outer position pushes the counter weight against a front stop surface of the carriage.

4 Claims, 1 Drawing Sheet

RECOIL ABSORBING FIREARM

TECHNICAL FIELD

The invention deals with a firearm formed by a housing with a slidably mounted carriage and a barrel with a muzzle brake and a breech block equipped with a return spring supported on a rear support surface of the housing.

PRIOR ART

When firearms, especially automatic firearms, are constructed, considerable attention is paid to measures for suppression of the effects of recoil, significantly reducing accuracy of firing. The generally known and used measures include the muzzle brake, which at the moment when the projectile is leaving the barrel redirects part of the gases backwards, thereby reducing the return movement of the barrel and the connected arm parts. The disadvantages of the muzzle brake include the fact that the braking effect only manifests itself when the projectile has left the barrel and passed its momentum onto the barrel. Therefore the muzzle brake does not prevent the recoil, it only reduces its effects. Firearms have been designed which resolve the recoil issue by addition of a counter weight slidably mounted outside the firearm housing. This counter weight is connected to the barrel in a way causing its reciprocal movement in relation to the recoil generating barrel. Such recoil redirecting mechanism is disclosed in the patent application GB 2256263. The mechanism consists of a weight slidably mounted outside the frame in parallel to the barrel axis. There is a travelling pulley mounted on it. On the front end of the frame there is a fixed pulley. One end of the cable is fixed to the frame and the other on the barrel. The cable winds around both pulleys in a way causing a forward pull of the weight in response to the backward movement of the barrel. The weight with the travelling pulley is permanently driven to the rear position with a spring fixed to the frame on its other end. The recoil effects of the shot are absorbed partly by the forward movement of the weight and partly by the spring. A visible disadvantage of this solution is the cable transmission with the pulleys outside the frame. In addition to the fact that as a consequence of the cable flexibility the compensation effect is delayed, the cable furthermore represents an impractical and indeed dangerous element.

This invention is directed toward a firearm with a substantially more advanced recoil compensation.

SUMMARY OF THE INVENTION

The aim is fulfilled with a firearm consisting of a housing in which an assembly of a carriage and a barrel with a muzzle brake, and a breech block are slidingly supported, the breech block being equipped with a return spring supported on a rear support surface of the housing. The firearm has a counter weight slidingly disposed in a longitudinal space located between the housing and the carriage and leaning by its support surface against a rear end of the return spring, the said counter weight being seated in its front position on a front stop surface of the carriage. The breach block is seated in its rear position on a rear stop surface of the carriage, a front end of the return spring also leaning against a front support surface of the housing in the front position of the breech block. A transfer element protrudes into the path of the breech block, the transfer element being simultaneously supported on the carriage and on the counter weight, and in an outer position pushing the counter weight against a front stop surface of the carriage.

The transfer element may be, inter alia, a double wedge or a cam.

BRIEF DESCRIPTION OF THE DRAWING

The invention will be further clarified with the help of the drawing whose

DETAILED DESCRIPTION OF PREFERRED EMBODIMENTS

Figure 1:
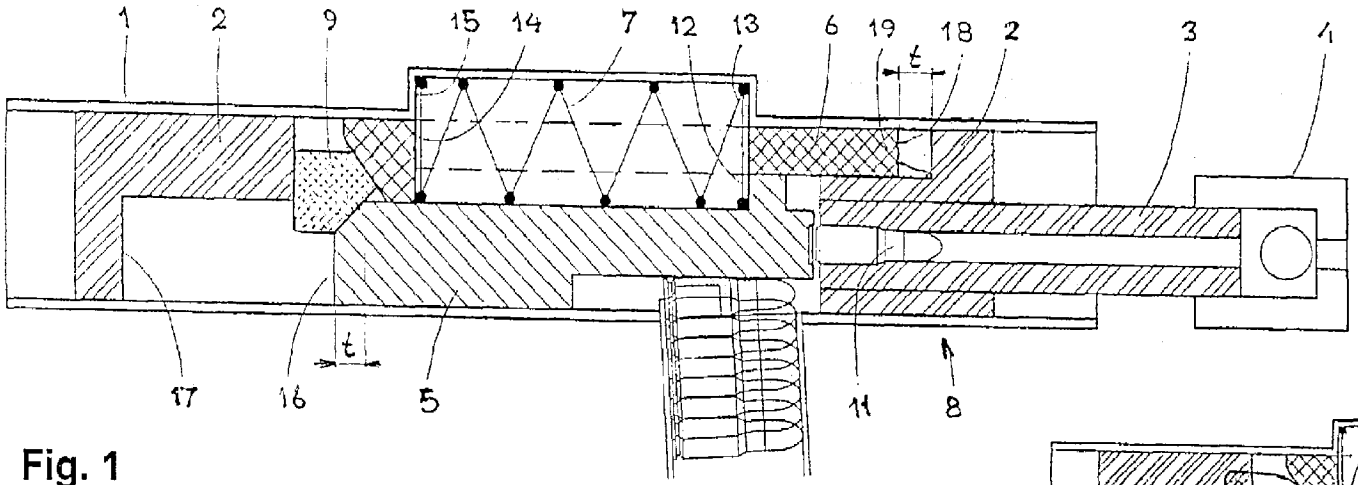
FIG. 1 shows a simplified schematic section of an automatic firearm before a shot with the projectile in the cartridge chamber.
Figure 3:
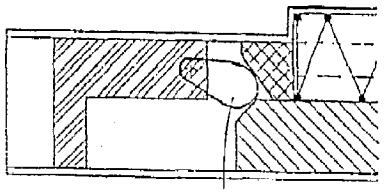
FIG. 3 shows a detailed layout of an alternative transfer element.
Figure 2:
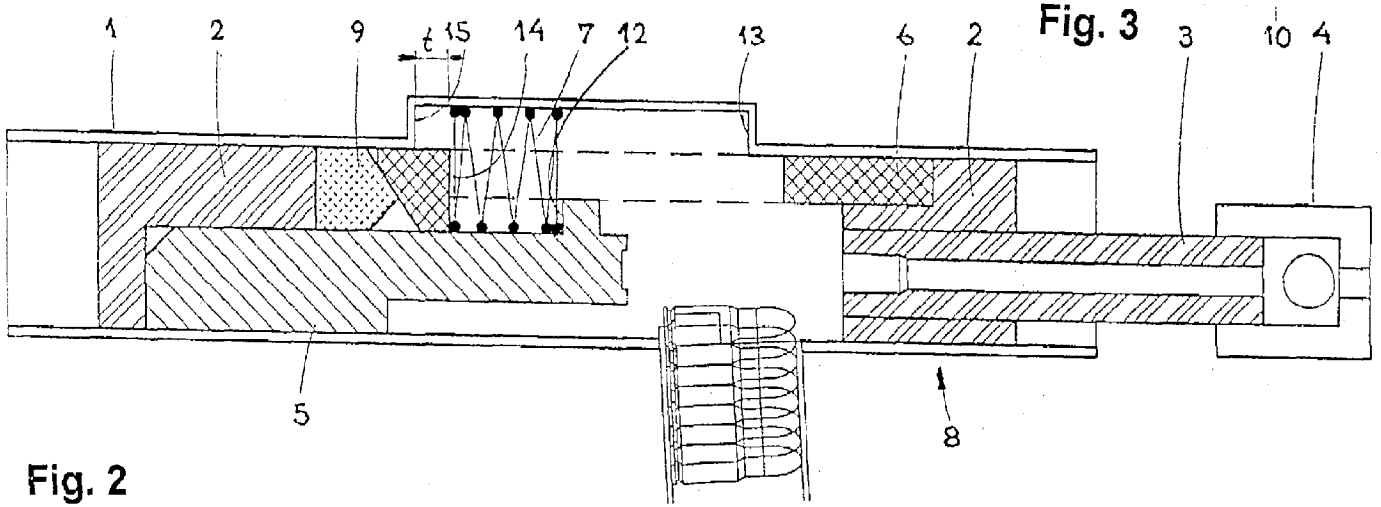
FIG. 2 shows the firearm from FIG. 1 after the shot at the moment when the projectile is leaving the barrel.

The firearm that is the subject of the present invention is formed by a housing 1, where the following parts are slidingly mounted: a carriage 2, which a barrel 3 with a muzzle brake 4 is screwed in, and a breech block 5. The longitudinal space located between the housing 1 and the carriage 2 hides a displaceably mounted counter weight 6 designed for partial compensation of the recoil after the shot with its forward movement, i.e. between the moment when the projectile begins to move and the moment when the projectile leaves the barrel 3. The breech block 5 is pushed to the front position with a return spring 7 supported with the rear surface of the housing 1. The barrel 3 with the muzzle brake 4 together with the carriage 2 form a single unit—a barrel assembly 8. For the purpose of the breech block 5 movement transfer to the forward movement of the counter weight 6 there is a transfer element which in its bottom position interferes with the path of the breech block 5 and which can move upwards. The transfer element shown in FIGS. 1 and 2 is a double wedge 9 supported at the same time on the carriage 2 and on the counter weight 6, while the transfer element shown in FIG. 3 is a cam 10 revolving in the carriage 2 where it is mounted and also supported on the counter weight 6. The transfer element may also take other forms, such as a ball, a roller, a double return lever and/or a bolted, cogged or hydraulic transmission.

In the position before a shot pursuant to FIG. 1 the breech block 5 is in its front position in relation to the housing 1 and the carriage 2, thus locking a cartridge with a projectile 11 in the projectile chamber of the barrel 3. The transfer element in the shape of a double wedge 9, or a cam 10 as in FIG. 3, protrudes into the path of the breech block 5, supported on the carriage 2 and reaching as far as the chamfered surfaces in the rear fronts of the counter weight 6 and the breech block 5. The spring 7 front end leans against a support surface 12 of the breech block 5 and at the same time against a front support surface 13 of the housing 1 and the rear end leans against a support surface 14 of the counter weight 6 and at the same time against a rear support surface 15 of the housing. Thus it defines the positions of all travelling parts of the arm in relation to each other and to the housing 1, i.e. the position of the breech block 5 and by means of it the position of the barrel assembly 8, mainly in the front position, and further the position of the counter weight 6 in its rear position and by means of it the position of the transfer element in its bottom position.

When the arm shoots, the breech block 5 is thrown to the rear, pushing the transfer element up. The transfer element displaces the counter weight 6 forward until its front end 18 hits a front stop surface 19 of the carriage 2, passing its momentum onto it. In the case of an identical chamfer angle of both bevelled surfaces of the transfer element in the shape of a double wedge 9, as in the example shown in FIGS. 1 and 2, the path t, on which the breech block 5 pushes the transfer element to start its movement, is identical with the total path of the counter weight 6.

In the position after a shot, a rear front 16 of the breech block 5 leans against a rear stop surface 17 of the carriage 2, the cartridge chamber is open, the transfer element is pushed off the breech block 5 path, pushing the counter weight 6 towards the front stop surface 19 of the carriage 2. The breech block 5 locks the transfer element after its pass together with the counter weight 6. The barrel assembly 8 together with the counter weight 6 and the transfer element act as a single body at this moment. The return spring 7 is pressed between the support surface 12 of the breech block 5 and the support surface 14 of the counter weight 6.

After loading the arm, the return spring 7 returns all travelling parts to their respective starting positions.

While during the shot the projectile 11 begins to move forward, all travelling parts of the arm start moving in different velocities together with the projectile. The travel direction of the breech block 5, the barrel assembly 8 and the transfer element is opposite to the direction of the projectile 11 movement. The travel direction of the counter weight 6, derived from the movement of the breech block 5 by means of the transfer element, is identical with the movement direction of the projectile 11. The length of the path of the counter weight 6 is limited so that at the moment when the projectile 11 leaves the barrel 3 the counter weight 6 hits the front stop surface 19 of the carriage 2 of the barrel, whereby the momentums of the counter weight 6 and the barrel assembly 8, including the transfer element, are mutually eliminated. The breech block 5 continues moving and its wall locks the counter weight 6 with the help of the transfer element in its front position in relation to the barrel 3. Thus at this moment the joined weight of the barrel assembly 8, the counter weight 6 and the transfer element act as a single summary weight. At the same time at the moment when the projectile 11 leaves the barrel 3 the gunpowder gases start the muzzle brake 4, which grants momentum to the summary weight of the barrel assembly 8, the counter weight 6 and the transfer element in the direction of the projectile movement 11, which is the same as the momentum of the breech block 5, but acting in the opposite direction.

The dimensioning of the muzzle brake 4 for the needed momentum of the summary weight of the barrel assembly 8, the counter weight 6 and the transfer element must be achieved by experimental continuous increase of the openings of the muzzle brake 4. As the effect of the current muzzle brakes may be up to 70% and the momentum of the breech block 5 makes about 15 to 30% of the projectile momentum (depending on the mutual ratios of the weights of all travelling parts of the arm and the transmission ratio of the transfer element), the mutual elimination of momentum of the breech block 5 against the momentum of the summary weight of the set consisting of the barrel assembly 8, the counter weight 6 and the transfer element is possible.

The weight of the breech block 5 and the summary weight of the barrel assembly 8, the counter weight 6 and the transfer element thus move with the same momentums, in opposite directions, until the breech block 5 rear front 16 hits the rear stop surface 17 of the carriage 2. At this moment all moving weights stop, including the weight of the breech block 5, the barrel assembly 8, the transfer element and the counter weight 6, and the whole cycle begins in the opposite order of loading a new projectile.

In the following physical expression of the above-described processes the below signs mean the following:

$m_{11}$—weight of the projectile 11, $v_{11}$—velocity of the projectile 11 at the moment when it leaves the barrel $m_5$—weight of the breech block 5, $v_5$—velocity of the breech block 5

$m_8$—weight of the barrel assembly 8, $v_8$—velocity of the barrel assembly 8

$m_9$—weight of the transfer element, $v_8$—velocity of the barrel assembly 8

$m_6$—weight of the counter weight 6, $v_6$—velocity of the counter weight 6 v—relative velocity of the breech block 5 and the counter weight 6 in relation to the barrel assembly 8, if $$p=q$$

p and q—coefficients expressing the transmission ratio of the transfer element 9, each time applying that p+q=2

The following applies to the relationship between the momentums:

$$m_5v_5+m_5v_5+(m_8+m_9)v_8+m_6v_6 \quad (1)$$

The following applies to the velocities of the individual travelling parts of the arm:

$$v_5=pv+v_8 \quad \text{relationship a}$$

$$v_8=v_8 \quad \text{relationship b}$$

$$v_6=qv-v_8 \quad \text{relationship c}$$

At the same time the following applies:

$$(m_8+m_9)v_8=m_6v_6 \quad (2)$$

$$\text{and } v_6=(m_8+m_9)v_8:m_6 \quad (2.1)$$

Comparison of relationship c with the equation (2.1):

$$v_6=v_6$$

$$qv-v_8=(m_8+m_9)v_8:m_6$$

$$v=(m_8+m_9+m_6)v_8:qm_6$$

And after substitution in the equation (1):

$$m_{11}v_{11}=m_5(pv+v_8)+(m_8+m_9)v_8+m_6(qv-v_8)$$

As $(m_8+m_9)v_8=m_6v_6$, these two momentums eliminate each other and the only remaining momentum is $m_5v_5$, which in the case of suitably selected weights $m_5$, $m_8$, $m_9$, $m_6$ and the transmission coefficients p, q may amount to less than 20% of the momentum $m_{11}v_{11}$.

The momentum $m_5v_5$ and the friction forces and resistances of drawing and throwing the cartridge, putting the projectile in the cartridge chamber and resistance of the firing pin spring are eliminated with a simple muzzle brake 4 mounted onto the barrel muzzle 3, with the corresponding necessary effect causing that during firing with single shots or a burst the housing 1 and thus the whole arm remain motionless with the final effect of complete elimination of the arm recoil.

The invention claimed is:

1. A firearm formed by a housing, in which an assembly of a carriage and a barrel with a muzzle brake, and a breech block are slidingly supported, wherein the breech block is equipped with a return spring that is supported on a rear support surface of the housing, comprising:

a counter weight being slidingly disposed in a longitudinal space located between the housing and the carriage, the support surface of the counter weight leaning against a rear end of the return spring, the counter weight being seated in a front position thereof on a first front stop surface of the carriage, the breach block being seated in a rear position thereof on a rear stop surface of the carriage, a front end of the return spring leaning against a front support surface of the housing at the front end in the front position of the breech block, whereby a transfer element protrudes into the path of the breech block, the transfer element being simultaneously supported on the carriage and on the counter weight, and in an outer position thereof pushing the counter weight against a second front stop surface of the carriage.

2. The firearm according to claim 1 wherein the transfer element is in the shape of a double wedge.

3. The firearm according to claim 1 wherein the transfer element is in the shape of a cam revolving in the carriage in which the cam is mounted.

4. The firearm according to claim 1 wherein a single front stop surface comprises both the first front stop surface and the second front stop surface.

* * * * *